United States Patent [19]

Seilly

[11] 4,329,951

[45] May 18, 1982

[54] FUEL INJECTION SYSTEM

[75] Inventor: Alec H. Seilly, North Wembley, England

[73] Assignee: Lucas Industries Limited, Birmingham, England

[21] Appl. No.: 94,903

[22] Filed: Nov. 16, 1979

[30] Foreign Application Priority Data

Apr. 21, 1979 [GB] United Kingdom ..... 7913938

[51] Int. Cl.[3] ..... F02D 5/02

[52] U.S. Cl. ..... 123/179 L; 123/491; 123/499

[58] Field of Search ..... 123/179 B, 179 L, 491, 123/490, 478, 499, 497, 498, 472

[56] References Cited

U.S. PATENT DOCUMENTS

| | | | |
|---|---|---|---|
| 3,812,830 | 5/1974 | Traisnel | 123/491 |
| 3,858,391 | 1/1975 | Davis et al. | 123/490 |
| 4,022,174 | 5/1977 | Brinkman | 123/499 |
| 4,165,727 | 8/1979 | Fitzner et al. | 123/179 L |
| 4,176,627 | 12/1979 | Bassi | 123/490 |

*Primary Examiner*—Charles J. Myhre
*Assistant Examiner*—Andrew M. Dolinar

[57] ABSTRACT

An engine system includes an internal combustion engine to which fuel is supplied by solenoid operated pump/injectors. Power is supplied to the injectors by a drive unit which is controlled by a control unit. The engine includes a starter motor which is energized from a battery by way of a time delay relay which comes into operation when a starter switch is actuated. The control unit is arranged so that energization of the starter when the switch is moved to the start position is delayed until the solenoids of all the pump/injectors have been energized to their maximum extent. When the cranking of the engine reaches a predetermined value the injectors are allowed to operate at about half stroke, each injector being operated at least twice to provide the required amount of fuel for starting purposes. Once the engine has started the system does not revert to normal operation until a sufficient period has lapsed for the terminal of the battery to rise to a value such that the pump/injectors are capable of supplying the required amount of fuel in a single stroke.

4 Claims, 6 Drawing Figures

ELECTRONIC CONTROL UNIT
1
2
3
4
62
ACCESSORIES
66
65
64
61
63
POWER UNIT
2
3
4
10
10
42
42
73
53
59
STORAGE ACCUMULATOR
PUMP/INJECTOR
58
54
SUPPLY PUMP
TRANSDUCER
57a
COMPRESSION IGNITION ENGINE
55
FILTER
STARTER MOTOR
57
RELAY
60
56
FUEL TANK

FUEL INJECTION SYSTEM

This invention relates to a fuel injection system for supplying fuel to an internal combustion engine and of the kind comprising at least one injection pump including a pumping plunger, a solenoid and an armature for directly actuating the pumping plunger upon energisation of the solenoid, the system including an injection nozzle through which fuel pressurised by the pumping plunger is allowed to flow in use, to an engine cylinder, the injection nozzle including a fuel pressure responsive valve which is opened to allow fuel flow when the pressure of fuel supplied to the nozzle attains a predetermined value.

With such a system the extent of movement of the plunger determines the amount of fuel supplied through the injection nozzle to the combustion space. For starting purposes it is usual to supply to an engine a quantity of fuel in excess of the normal maximum quantity of fuel and the supply of this excess quantity of fuel will demand an increase in the movement of the plunger and the armature. This means that when the extra amount of fuel is being supplied the air gap or gaps in the magnetic circuit of the solenoid and armature will be larger and the resultant force available when the solenoid is energised, will be less than when the normal maximum amount of fuel is supplied.

The valve in the injection nozzle requires a pre-determined fuel pressure to be developed before it is opened and therefore even when the extra amount of fuel is being supplied, the force available must be at least sufficient to develop the aforesaid pre-determined pressure.

In an engine for a vehicle the electric supply for the solenoid will be obtained from the storage battery of the vehicle which also provides the necessary power for the starting motor of the engine. When the engine is cold the terminal voltage of the battery may fall by as much as a half, when the starting motor is energised and therefore with the system as described the solenoid would have to be designed to provide sufficient force at half the normal supply voltage and in the situation when the air gap or gaps is/are at a maximum. This would mean that the solenoid would be unnecessarily large for the situation of normal operation of the engine i.e. when the battery voltage is at or near its nominal value and when the normal maximum amount of fuel is required to be supplied. If however the solenoid is designed to cope with an adequate safety margin, with normal running of the engine it would not effect injection of fuel under the cold starting conditions mentioned above.

If the initial air gap is reduced then even with a solenoid designed for normal running of the engine, sufficient force can be developed even with the battery voltage reduced to half its nominal value. In this condition however insufficient fuel would be delivered to the engine. This objection however may be overcome by arranging for the pump to be operated at least twice to supply the required volume of fuel. Such repeated operation must take place in timed relationship with the associated engine and in rapid succession since it is clearly no use supplying fuel to an engine cylinder during for example the exhaust stroke of the engine.

According to the invention a system of the kind specified comprises first means operable to delay the operation of the starting motor of the engine upon closure of an operator control switch, second means operable to effect energisation of the solenoid or solenoids of the pump or pumps whilst the starting motor is de-energised, thereby to cause the air gaps in the magnetic circuits to be reduced to a minimum, said solenoids being maintained in an energised state until cranking of the engine takes place whereupon the solenoids are de-energised and energised in rapid succession to cause delivery to the respective injection nozzles in timed relationship with the engine, of charges of fuel which together make up the required volume of fuel for starting purposes.

An example of a fuel system in accordance with the invention will now be described with reference to the accompanying drawings.

Figure 2:
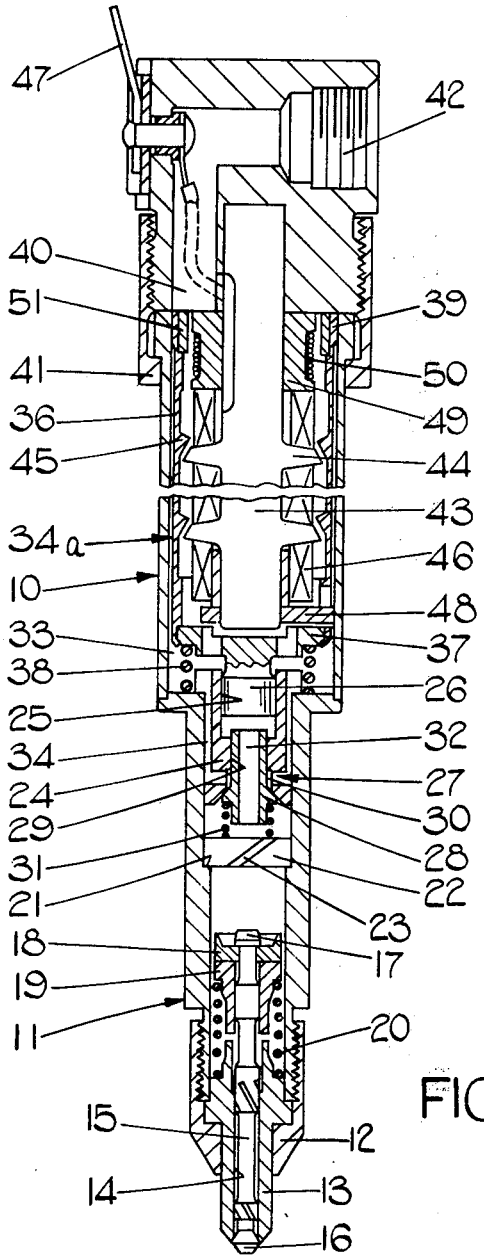
FIG. 2 is a sectional side elevation of a pump/injector incorporated into the engine system.

Before describing the engine installation, reference will be made to FIG. 2 of the drawings which shows a combined fuel pump and injection nozzle, hereinafter called a pump/injector and having the reference 10. The pump/injector comprises a hollow cylindrical stepped body 11 the narrower end of which is screw threaded to receive a retaining nut 12 which retains on the body a nozzle head 13. The nozzle head 13 has an end portion of conical form in which is defined a seating located at the end of a centrally disposed bore 14. Within the bore is located a valve member 15 which has a head 16 for co-operation with the aforesaid seating. The valve member 15 is guided for movement within the bore 14 by fluted portions integrally formed with the valve member and the diameter of the valve member is such that it can be passed through the portion of the bore which defines the seating. At its end remote from the head the valve member has a portion 17 against which is located a locking member 18 which has a lateral slot to permit it to be located about a reduced portion of the valve member beneath the portion 17. The locking member retains a spring abutment 19 in position and located between the abutment 19 and a portion of the nozzle head in a coiled compression spring 20 which biases the head 16 into contact with the seating.

The body 11 is provided with a central bore into which extends a portion of the nozzle head 13 and the latter is provided with a flange which is held in sealing engagement with the end of the body 11 by the retaining nut 12. Alternatively the flange may be secured by rolling a reduced end portion of the body over the flange or by electron beam welding the flange to the body.

Extending into the bore in the body 11 is a cylindrical flanged valve mounting 24. The mounting is secured in this bore and formed within the mounting itself is a stepped bore. The wider portion 25 of this bore constitutes a cylinder for a plunger 26 whilst the intermediate portion 29 accommodates a valve element 27. A slightly enlarged portion 30 of the bore is shaped at its end to define a seating for a valve head 28 forming part of the valve element 27. The valve head 28 is biased into contact with the seating by means of a light coiled compression spring 31 and extending through the valve element is a passage 32. The spring 31 seats against a member 22 which is located against a step 21 in the bore in the body, the member 22 having a peripheral groove or grooves 23 along which fuel can flow. The portion 30 of the bore communicates with a chamber 33 defined in an enlarged portion of the body 11 by way of longitudinal grooves 34 formed in the outer surface of the valve mounting and which are connected by transverse drillings to the aforesaid portion 30 of the bore. The valve element projects into the aforesaid cylinder 25 and it can be engaged as will be described by the piston 26.

An electromagnetic means generally indicated at 34A is located within the chamber 33 for moving the plunger 26 in the direction to displace fuel from the cylinder 25. The electro-magnetic means comprises a thin walled armature 36 which is of tubular form and is connected to a plate-like part 37 which is integrally formed with the piston 26. The plate-like part is provided with apertures extending there through to facilitate the flow of fuel and it also serves as an abutment for a coiled compression spring 38 which biases the plunger 26 away from the valve element. The armature is guided for movement by the piston 26 and at its other end by an enlargement 39 slidable on the interior surface of the body 11.

The open end of the body 11 is closed by an end closure 40 which is retained in position by means of a retaining nut 41, this engaging a flange on the body. The end closure defines a fuel inlet 42 which communicates with the chamber 33 and it also supports a solenoid or stator assembly. The stator assembly comprises a rod 43 formed from magnetisable material and which extends within the armature and which is provided on its peripheral surface with a pair of helical ribs 44. The interior surface of the armature is also provided with helical ribs 45 and the presented surfaces of the ribs 44 and 45 are inclined to the longitudinal axis of the pump/injector. In addition the surfaces are spaced from each other in the de-energised condition (as shown) of the electromagnetic means.

In the two grooves defined between the ribs 44 are located a pair of windings 46. The windings conveniently are formed by winding wire along one groove from one end of the rod and returning along the other groove to the same end of the rod. The windings have a plurality of turns and when electric current is supplied thereto the flow of current in the windings in the two grooves is in the opposite direction so that the ribs 44 assume opposite magnetic polarity. The end connections of the windings are connected to terminal pieces indicated at 47 and mounted on the end closure 40.

The extent of movement of the armature under the action of the spring 38 is limited by the abutment of the armature with the end closure and furthermore, the armature is retained against angular movement by means of a locating member 48 which is secured to the rod at its end adjacent the piston and which extends through an aperture in the armature.

The pump/injector also incorporates a transducer for providing an indication of the position of the armature. The transducer comprises a core member 49 which is located about the rod 43 at the end thereof adjacent the end closure. The core member is provided with a circumferential groove in which is located a winding 50 and the armature mounts a ring 51 formed from non-magnetic material and which as the armature moves, alters the reluctance of the magnetic circuit formed by the core and ring thereby altering the inductance of the winding 50, this winding being supplied from a high frequency source.

The operation of the pump/injector will now be described assuming that the various parts are in the position shown in the drawing. In this position and as will be explained, the cylinder 25 is completely filled with fuel and the valve head 28 is in contact with its seating. When the windings 46 are supplied with electric current the armature moves downwardly against the action of the spring 38. The fuel in the cylinder is therefore pressurised by the plunger 26 and this pressure acts upon the head of the valve member 15. When the pressure reaches a pre-determined value the head 16 is lifted from its seating against the action of the spring 20 and fuel flows from the nozzle head, the fuel being atomised during its passage past the valve head. This flow of fuel continues until the plunger engages with the valve element 27 but as soon as this occurs the head 28 is lifted from its seating against the action of the spring 31. The pressure of fuel in the cylinder falls to that within the chamber 33 and there is therefore a rapid reduction in the pressure of fuel acting on the valve head 16. The spring 20 moves the valve head into contact with its seating so that further flow of fuel and in particular unatomised fuel, is prevented from leaving the nozzle head. The piston will continue to move downwardly until the part 37 engages with the end of the valve mounting. It has already been mentioned that the presented faces of the ribs 44 and 45 are inclined to the axis of the pump/injector. The purpose of such inclination is to obtain a more linear force/distance characteristic during movement of the armature. In practice the current flow to the winding will be reduced when or slightly before the plunger contacts the valve element 27. The plunger will continue to move due to its inertia and the decaying magnetic flux.

When the winding is de-energised the spring 38 will effect upward movement of the plunger and the armature. During such movement it can be expected that the pressure within the cylinder will be lower than that in the chamber 33. The effect is that the valve head 28 is maintained off its seating by the pressure of fuel in the chamber 33 acting on the valve head. If the maximum volume of fuel is required then the piston is allowed to move its maximum distance under the action of the spring 38 and once movement of the plunger has halted and the pressure within the cylinder has become substantially the same as that within the chamber 33, the valve element moves under, the action of the spring 31 to the closed position. The pump/injector is then ready for a further delivery of fuel.

If it is required that the pump/injector should deliver less than its maximum volume of fuel then the return motion of the armature under the action of the spring 38 must be halted at some intermediate position. The aforesaid transducer provides a signal indicative of the position of the armature and therefore the distance, and using this signal it is possible to partly energise the windings when the piston has moved by the required amount. Such partial energisation of the windings creates sufficient force to hold the armature against the action of the spring 38 but does not pressurise the fuel in the cylinder by an amount sufficient to effect opening of the valve member 15 in the nozzle head. It will be seen that the filling of the cylinder can take place at any time after termination of fuel delivery and before the next delivery of fuel is required.

Figure 1:
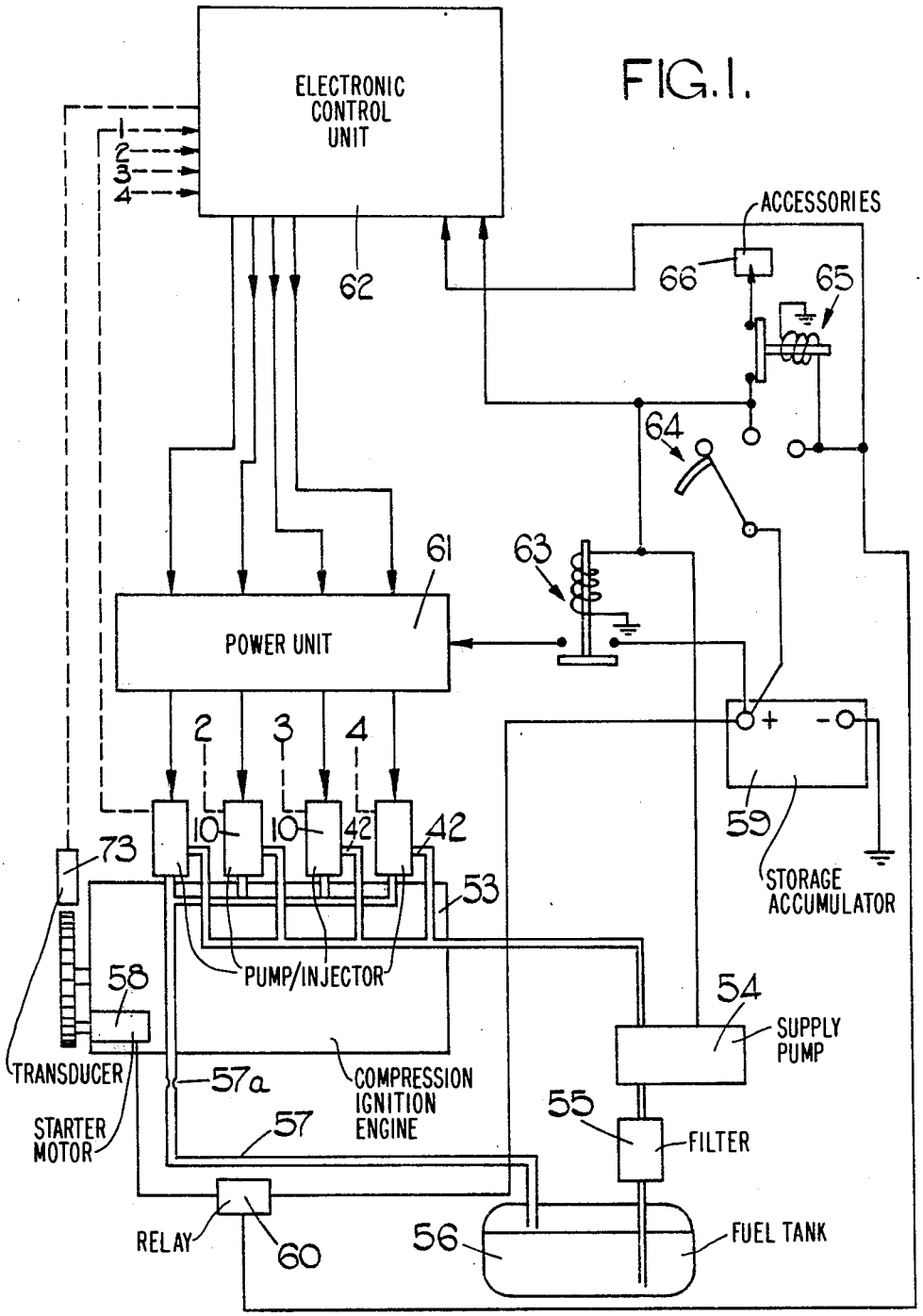
FIG. 1 is a diagram showing an engine installation.

Turning now to FIG. 1 there is shown at 53 a four cylinder compression ignition engine with four pump-/injectors indicated at 10. Fuel is supplied to the inlets 42 of the pump/injectors by an electrically driven supply pump 54 which draws fuel by way of a filter 55 from a fuel tank 56. A continuous flow system is provided and surplus fuel is returned to the tank by way of a pipe-line 57 which in use will incorporate a restrictor 57*a* or a pressurising valve so that a predetermined fuel inlet pressure is maintained at the inlets 42 of the pump injectors.

The engine is provided with a starter motor 58 which is supplied with electric current from a storage accumulator 59 by way of a delayed action relay 60.

The windings 46 of the pump/injectors 10 are supplied with power by means of a power unit 61 which draws its power from the accumulator 59. The power unit may include respective power transistors or thyristors and the conduction of the transistors or thyristors is controlled by an electronic control unit 62. The control unit 62 receives the output signals from the transducers in the pump/injectors and its construction will be further described with reference to FIGS. 3 and 4. Electric power is supplied to the power unit 61 by way of the normally open contacts of a relay 63. The winding of the relay 63 is energised when an operator controlled switch 64 is moved from the off position in which it is shown, to the run position. When in the run position and also when the switch is moved further to a start position, current is supplied from the accumulator 59 to the control unit 62 and also to the pump 54. In the start position current supplied to the aforesaid relay 60 and a signal is supplied to the control unit 62. In addition the winding of a normally closed relay 65 is energised this disconnecting the accessories 66 of the vehicle from the accumulator so as to reduce the current drain on the accumulator.

Figure 3:
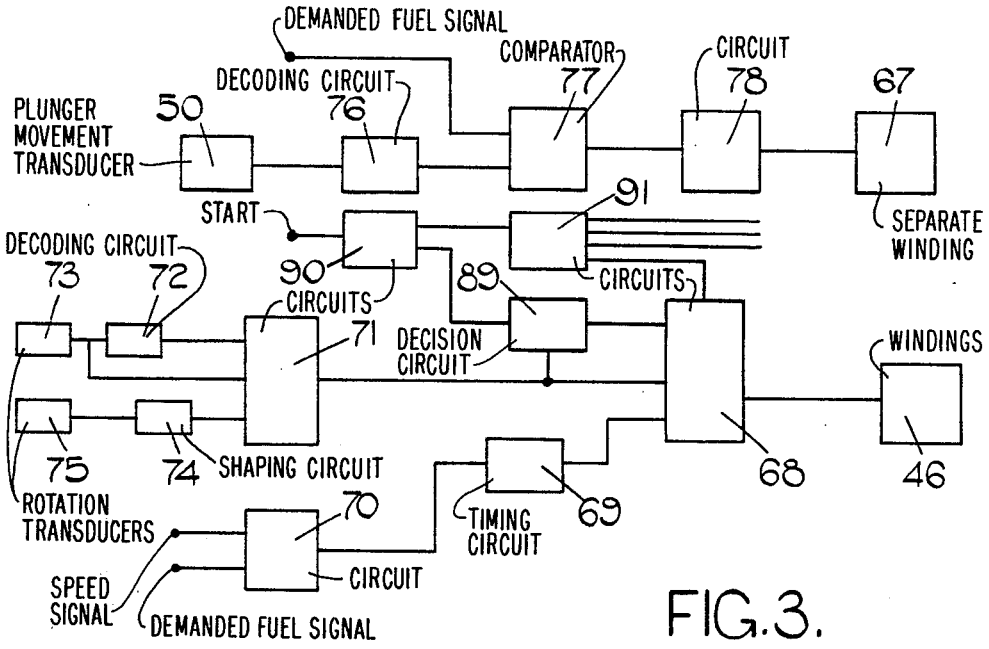
FIG. 3 shows in block form a control system for the injector.
Figure 5:
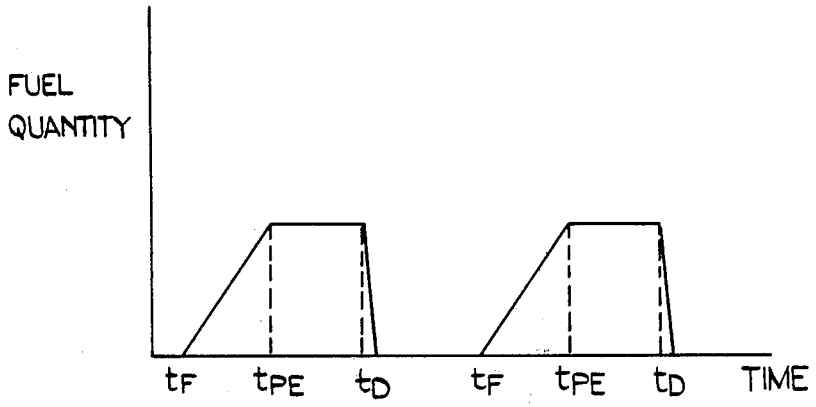
FIG. 5 shows the operation of the system under normal conditions.

Turning now to FIG. 3 which shows a control system for a single pump injector, the winding 46 is shown as a block as also is a separate winding which is referenced 67 the separate winding is for the purpose of holding the piston at some stage during its return movement under the action of the spring 38 as will be explained. The winding 46 is supplied with current when the signal appears at the output of a circuit 68 which has two inputs one of which is connected to a circuit 69 which determines the desired timing of the delivery of fuel i.e. the time tD in FIG. 5. The circuit 69 is supplied with the output of a circuit 70 in which is stored information regarding the timing characteristics of the engine 53. The circuit 70 is supplied with an engine speed signal and also a signal representing the amount of fuel to be supplied to the engine. The other input of the circuit 68 is connected to the output of a circuit 71 which provides a signal indicative of the position of the rotary parts of the engine. At the required engine position the winding 46 is energised to effect delivery of fuel. In FIG. 5 delivery is shown to start at time tD energisation of the winding must however occur slightly before this time in order to allow time for the current to rise and the magnetic flux to increase to a value such that the force applied to the piston is sufficient to raise the pressure to the level required to open the valve 15. The average level of current flow in the winding is decreased, before the delivery of fuel is complete. The piston continues to move due to its inertia and also because the current takes a time to decay. The level of current flow in the winding 46 is maintained at a low level for the period of time tD-tF in FIG. 5 by the circuit 68.

The engine position signal is provided by the circuit 71 which receives an engine speed signal from a de-coding circuit 72 which in turn receives a pulse input from a transducer 73. The transducer 73 is positioned adjacent a rotary part of the engine such that in the particular example four pulses are provided per revolution of the engine. The transducer is indicated in FIG. 1 as being located adjacent the fly wheel of the engine but in fact it is responsive to four marks on the fly wheel. The pulses are fed to the circuit 71 as also is a pulse signal from a shaping circuit 74 having its input connected to a transducer 75. This transducer provides a pulse signal every two revolutions of the engine and from the signals an engine position signal is produced.

When point tF is reached the winding 46 is de-energised and the plunger 26 starts to move under the action of the spring to draw the fuel back into the pumping chamber. An indication of the movement of the plunger is provided by the transducer contained within the pump/injector. The signal from the transducer which is referenced 50, is supplied to a de-coding circuit 76 and then to one input of a comparator 77. The other input of the comparator is supplied with a signal representing the demanded fuel and the derivation of this signal will be explained later. When the actual fuel signal obtained at the output of the de-coder equals the demanded fuel signal, a signal is supplied to a circuit 78 which then supplies the winding 67 with electric current and a further movement of the plunger is halted. In FIG. 5 the winding 67 is energised at time tPE. It will be appreciated that instead of providing the additional winding 67, the winding 46 may be partly energised. At time tD the winding 67 if it is provided, is de-energised and the winding 46 energised alternatively the winding 46 is fully energised.

Figure 4:
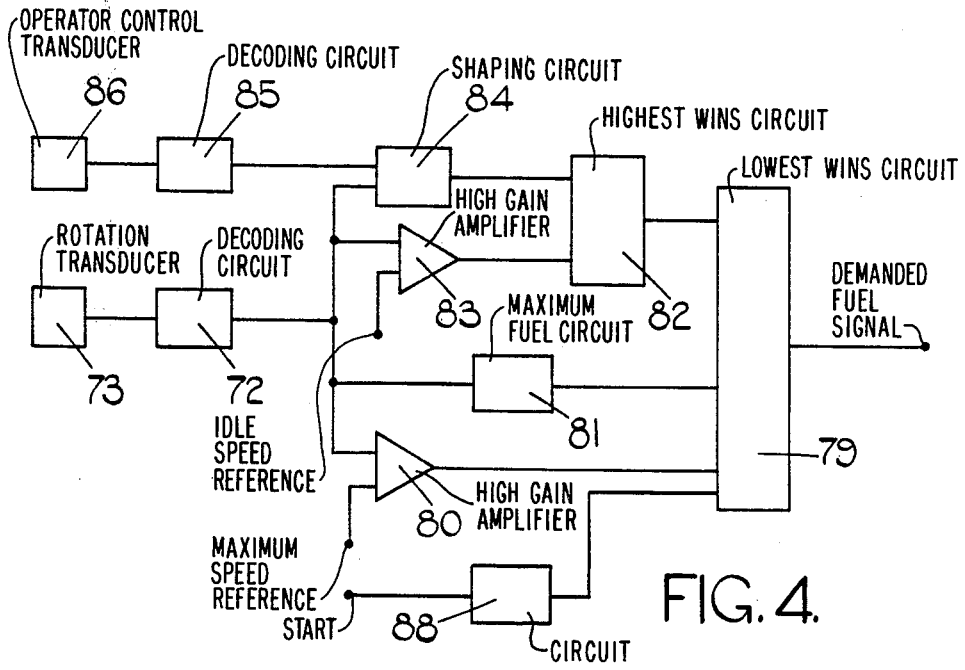
FIG. 4 is a diagram of an electronic governor.

Referring now to FIG. 4, this shows a circuit for providing the demanded fuel signal to the comparator 77 and the circuit 70. The circuit of FIG. 4 provides a two speed governing effect and includes a lowest wins circuit 79 the output of which constitutes the fuel demand signal. The circuit 79 has three inputs the lowest of which is selected by the circuit for supply as the fuel demand signal. One input of the circuit 79 is connected to the output of a high gain amplifier 80 provided with feed back. One input of the amplifier is provided with a reference signal representative of the maximum allowed engine speed whilst the other input is supplied with the actual engine speed signal from a de-coding circuit shown as the de-coding circuit 72 of FIG. 3.

The second input of the circuit 79 is connected to a circuit 81 which also receives the speed signals and provides a signal representing the maximum fuel signal throughout the speed range of the engine. The third input of the circuit 79 is connected to the output of a highest wins circuit 82 which has two inputs. The first input is connected to the output of a high gain amplifier 83 provided with feed back and having two inputs one of which receives a reference signal representing the desired engine idling speed and the other of which receives the engine speed signal. The second input of the circuit 82 is connected to the output of a shaping circuit 84 which receives the engine speed signal and also a signal from a de-coding circuit 85 which in turn receives a signal from a transducer 86 associated with an engine operator adjustable control e.g. the throttle pedal in the case of a road vehicle.

In operation at engine idling speeds the amplifier 83 is operative to determine the demanded fuel signal at the output of the circuit 79 since with no demand on the part of the operator, the output from the amplifier will be larger than the output from the shaping circuit but smaller than the output of the circuit 81 and the amplifier 80. When the operator places a demand on the engine by depressing the throttle pedal, then the output of the shaping circuit becomes higher than the output of the amplifier. If only a small demand is made then the signal from the circuit 82 will still be lower than those provided by the circuit 81 and the amplifier 80 and the driver will control directly the amount of fuel supplied to the engine and with an increased flow of fuel the engine will accelerate. If the operator makes a large demand on the engine then it is likely that the output of the circuit 82 will be greater than the output of the circuit 81 in which case the rate of fuel supply will be controlled by the circuit 81 until the output of the circuit 82 becomes smaller thereby restoring the control of the fuel supply to the operator.

If the maximum allowed engine speed is attained then the output of the amplifier 80 becomes less and the fuel supply to the engine will be reduced to control the speed of the engine. The shaping circuit 84 is arranged to modify the apparent demanded fuel in accordance with engine speed to provide feed back to the operator of the engine. Furthermore, the idling speed may be modified in accordance with variation in low demand on the part of the operator. This provides a smooth transition from the control by the amplifier 83 to the control by the circuit 82 and eliminates "lost motion" in the operator adjustable control.

The governor circuit may be modified in many ways to provide for example a change in the idling speed with engine temperature, modification of the maximum fuel delivery in accordance with the ambient air pressure and/or temperature, and modification of the maximum fuel delivery with the pressure in the air inlet manifold of the engine. It will be appreciated that the control unit 62 embodies the circuits of FIG. 3 and FIG. 4. The circuit shown in FIG. 4 will be common to the four injectors and this also applies to a number of the components shown in FIG. 3.

When starting a cold engine the initial flow of current to the starting motor is of such magnitude that the terminal voltage of the storage battery can fall to a very low value. As the engine is turned and its speed increases to the cranking speed, the terminal voltage of the battery increases to a value which is still substantially below the nominal terminal voltage. It is also known that when starting a cold engine it is necessary to supply a quantity of fuel in excess of the normal maximum quantity.

In order to provide the maximum amount of fuel the plunger must be allowed to move its maximum extent under the action of the spring 38 and this means that the gaps between the ribs 44 and 45 will be at their maximum. For a given current flow in the windings the force will be at a minimum. In order to guarantee the injection of the extra volume of fuel even when the engine has reached its cranking speed it would be necessary to design the windings such that the magnetic flux would be sufficient to effect movement of the plunger and this would require a high current flow in the windings and an increase in the size of the electromagnetic device. As an alternative the size of the storage battery could be increased but there would need to be a substantial increase in the size of the battery.

So that the electromagnetic device does not need to be designed specifically with the problem of starting the engine in mind, the control unit 62 is arranged so that for the purpose of engine starting, the operation of the system is modified. Firstly it is proposed to delay the operation of the starting motor using the relay 60, for a short interval of time after the operator has turned the starter switch 64 to the start position in which the engine starter motor is energised. In this interval of time all the windings 46 are supplied with electric current. Since the terminal voltage of the storage battery will be more or less its nominal value and even though the air gaps between the ribs 44 and 45 will be at their maximum because of the action of the respective springs 38, the plungers will be moved and the whole contents of the respective cylinders 25 will be discharged into the respective combustion spaces of the engine. The fuel thus discharged will have little if any influence on the starting of the engine although it will help to seal and lubricate the pistons of the engine. The windings are held energised at a reduced current level thereby maintaining the plungers at the innermost ends of their strokes.

At the ends of the aforesaid interval of time the starter motor is energised and only when the cranking speed of the engine reaches a certain value, say 60 R.P.M., is fuel supplied to the engine. As explained the terminal voltage of the storage battery will still be substantially below its nominal value and the plungers could not be moved through their maximum stroke. It is therefore proposed that the excess volume of fuel should be delivered in two or more discrete volumes which together make up the required volume. The reason for this is that if the plungers are allowed to return only say half their maximum stroke, the air gaps between the ribs 44 and 45 will only be half of what they would be if the plungers were allowed to partake of their maximum strokes. The force available to move the plungers will therefore be sufficient to move the plungers even though the magnitude of the current flows will be reduced because of the low terminal voltage of the storage battery.

It will be appreciated that when the engine is being cranked there is because of the low speed, a much longer time available for the pump/injectors to be operated and whilst the first delivery of fuel might be effected a few degrees in advance of what would be considered normal for the engine, the second or further deliveries of fuel can follow very quickly so that it can be said that the injection of fuel takes place more or less at the correct time.

When the engine has started it will take time for the charging system usually an alternator, of the storage battery to settle down and therefore it is arranged that only say half the maximum amount of fuel can be supplied to the engine for a short period. This period allows the charging system to raise the terminal voltage of the storage battery to a value approaching its nominal value so that at the end of the period the fuel system can reliably provide the normal maximum amount of fuel should this be required. The period can be a fixed time period say for example three seconds or the period can be as long as it takes the terminal voltage of the battery to rise to a value at which the pump/injectors can operate reliably to provide the normal maximum amount of fuel. For this purpose the control unit 62 incorporates means for sensing the terminal voltage of the battery.

Figure 6:
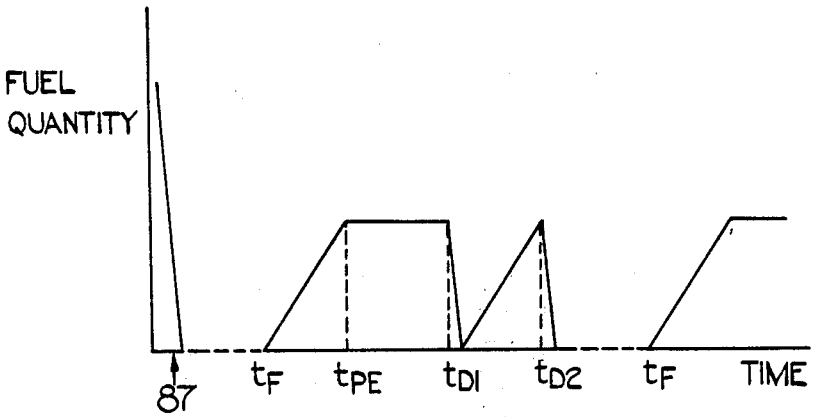
FIG. 6 shows the operation of the system under starting conditions.

FIG. 6 shows a diagram similar to FIG. 5 of the revised method of operation. The initial discharge of the injectors is indicated at 87 and then follows the first delivery of fuel with the solenoid being de-energised at time tF, partly energised at time TPE, and fully energised at time tD1. When the fuel has been delivered, the solenoid is de-energised and as soon as the required amount of fuel has flowed into the bore 25, it is re-energised at time tD2. Thereafter the solenoid remains at least partly energised until time tF of the next cycle. During the period between the initial discharge and the first delivery of fuel the engine starter is operated and the engine speed allowed to rise to say 60 R.P.M. When the engine has started the double delivery of fuel by the pump/injector is allowed to continue for the aforesaid period to allow the terminal voltage of the battery to rise. Thereafter the desired volume of fuel is supplied by the pump/injector at each delivery stroke.

In order to provide for energisation of the windings during the starting period a circuit 88 is provided which provides a further input to the wins circuit 79. The circuit 88 is activated when the manually operable control switch is moved to the start position and it provides an input to the circuit 79 which when the engine is at rest is less than the other inputs so that it determines the output of the circuit 79. The magnitude of the signal is such that half or less plunger movement will take place.

Also provided is a circuit 90 which is activated when the manually operable control switch is moved to the start position. The circuit 90 has a first output which is connected to a circuit 91 which has connections to each of the circuits 68 associated with the pump/injectors. The purpose of the circuit 91 is to cause full energisation of the windings 46 as soon as the control switch is moved to the start position.

The circuit 90 has a second output which is connected to one input of a circuit 89 also receiving an input from the circuit 71 and having its output connected to the circuit 68. The second output from the circuit appears only when the engine speed during cranking attains a predetermined value (60 RPM) and it is applied to the circuit 89. This circuit decides the additional number of plunger actuations required at the reduced stroke and supplies the appropriate number of signals to the circuit 68. Since it is required that the plunger should continue to operate at less than full stroke after the engine has started to allow the battery voltage to attain its nominal value the circuit may be supplied with a signal representative of the battery voltage so that the signal to the circuit 89 is maintained until the battery voltage attains the required value.

When the control switch is moved to the new position after the engine has started a governing action will be provided by the circuits 80 or 83.

I claim:

1. An engine system including an internal combustion engine having a plurality of combustion spaces, a plurality of fuel injection nozzles mounted on the engine to direct fuel into the combustion spaces respectively of the engine, a plurality of fuel injection pumps for supplying fuel to the injection nozzles respectively, electromagnetic means for actuating the pumps respectively each electromagnetic means including a solenoid and an armature, a starting motor for the engine, a storage battery, a delayed action relay for connecting the starting motor to the storage battery to achieve cranking of the engine, a manually operable switch movable from an off position to a first position and from the first position to a second position, a first contact on said switch which is connected to said battery in the first and second positions of said switch, a second contact on said switch which is connected to said battery in the second position of the switch, said second contact being connected to said delayed action relay whereby the starting motor will be rendered operative when the switch is moved to said second position and after the delay period of the relay, an electronic control unit which controls the supply of current to said solenoids so that the solenoids are energized in timed relationship with the engine, said control unit being connected to said first contact of the switch so that it is energized in the first and second positions of the switch, a first input to said control unit from said second contact, first circuit means in said control unit for energizing said solenoids when said switch is initially moved to said second position, second circuit means in said control unit for ensuring reduced displacement of the fuel injection pumps when said switch is moved to said second position, and third circuit means in said control unit for ensuring multioperation of said injection pumps to achieve the required volume of fuel for starting the engine.

2. An engine system as claimed in claim 1 the control unit including fourth circuit means operable after the engine has started to control the operation of the pumps so that fuel is supplied to the engine in timed relationship thereto by a single stroke of the pumps.

3. An engine system as claimed in claim 2 the control unit including fifth circuit means operable to delay operation of the fourth circuit means until after starting of the engine, a period has lapsed sufficient to allow charging of the battery sufficient to raise its terminal voltage to a level adequate for reliable operation of the pumps at full stroke.

4. An engine system as claimed in claim 3 in which said fifth circuit means includes means responsive to the terminal voltage of the battery.

* * * * *